US005144868A

United States Patent [19]

Feigel, Jr.

[11] Patent Number: 5,144,868

[45] Date of Patent: Sep. 8, 1992

[54] POWER TONGS

[76] Inventor: Kurt R. Feigel, Jr., 1227 - 110A Street, Edmonton, ALberta, Canada, T6J 6N6

[21] Appl. No.: 694,781

[22] Filed: May 2, 1991

[30] Foreign Application Priority Data

May 8, 1990 [CA] Canada ..... 2016319

[51] Int. Cl.[5] ..... B25B 17/02; B25B 17/00

[52] U.S. Cl. ..... 81/57.15; 81/57.14

[58] Field of Search ..... 81/57.14, 57.15, 57.18, 81/57.21

[56] References Cited

U.S. PATENT DOCUMENTS

| | | | |
|---|---|---|---|
| 2,879,680 | 3/1959 | Beeman . | |
| 4,084,453 | 4/1978 | Eckel . | |
| 4,089,240 | 5/1978 | Eckel . | |
| 4,095,493 | 6/1978 | Haynes | 81/57.15 |
| 4,350,062 | 9/1982 | Farr et al. . | |
| 4,404,876 | 9/1983 | Eckel . | |
| 4,487,092 | 12/1984 | Neves . | |
| 4,576,067 | 5/1986 | Buck . | |
| 4,590,823 | 5/1986 | Neves et al. | 81/57.15 |
| 4,593,584 | 1/1986 | Neves . | |
| 4,631,987 | 12/1986 | Buck . | |
| 4,649,777 | 3/1987 | Buck . | |
| 4,709,599 | 12/1987 | Buck . | |

FOREIGN PATENT DOCUMENTS

| | | |
|---|---|---|
| 1037463 | 8/1978 | Canada . |
| 1075676 | 4/1980 | Canada . |
| 1088918 | 11/1980 | Canada . |
| 1125737 | 6/1982 | Canada . |
| 1190919 | 7/1985 | Canada . |
| 1235111 | 4/1988 | Canada . |

*Primary Examiner*—Douglas D. Watts
*Assistant Examiner*—Paul M. Heyrana
*Attorney, Agent, or Firm*—Anthony R. Lambert

[57] ABSTRACT

A power tong includes a frame having arcuate front portions defining a throat, a cage plate assembly mounted on the frame for rotation about a central axis and a ring gear also mounted on the frame for rotation about the axis. The throat receives the pipe to be rotated, and the cage plate and ring gear include die means for gripping the pipe. The ring gear and cage plate cooperate to rotate the pipe within the frame, which remains stationary. The design of the power tong is such that the arcuate front portions of the frame are more flexible than the cage plate assembly and ring gear combination, and strain is primarily taken up by the ring gear and cage plate. In addition, the cage plate and ring gear are sufficiently rigid such that they may not flex to a degree that teeth on the ring gear flex more than the backlash in the gear train that drives the ring gear. Finally, the ring gear includes offset cam surfaces, which help to ensure that the pipe is centrally located within the ring gear, the cam surfaces having identical elliptical sections.

5 Claims, 4 Drawing Sheets

FIG. 3 : SECTION '3 – 3'

POWER TONGS

FIELD OF THE INVENTION

This invention relates to power tongs.

BACKGROUND OF THE INVENTION

Power tongs are used in well drilling to rotate tubular sections that are being threaded together or unthreaded There exist numerous patents on power tongs, including the following recent U.S. Pat. Nos. 4,709,599 to Buck, 4,649,777 to Buck, 4,631,987 to Buck, 4,576,067 to Buck, 4,593,584 to Neves (equivalent to Canadian patent 1,235,111), U.S. Pat. Nos. 4,487,092 to Neves, 4,404,876 to Eckel, 4,350,062 to Farr et al, (equivalent to Canadian patent 1,125,737), U.S. Pat. Nos. 4,089,240 to Eckel, 4,084,453 to Eckel, and 2,879,680 to Beeman et al; and the following Canadian patents: 1,190,919 to Farr et al, 1,088,918 to Eckel 1,075,676 to Eckel, and 1,037,463 to Eckel.

All of these power tongs include a frame having arcuate front portions defining a throat, a cage plate assembly mounted on the frame for rotation about a central axis and a ring gear also mounted on the frame for rotation about the axis. The throat receives the tubular section to be rotated, and the cage plate and ring gear include die means for gripping the pipe. The ring gear and cage plate cooperate to rotate the pipe within the frame, which remains stationary. The design of all of these power tongs is such that the arcuate front portions of the frames are more rigid than the cage plate assembly and ring gear combination, and strain is transmitted directly from the ring gear and cage plate to the frame. In addition, the cage plate and ring gear are sufficiently flexible such that they may flex to a degree that teeth on the ring gear flex more than the backlash in the gear train that drives the ring gear. Finally, while several of the patents show offset cam surfaces, which help to ensure that the pipe is centrally located within the ring gear, the cam surfaces used are either circular or spiral.

SUMMARY OF THE INVENTION

The inventor has designed a power tong that overcomes some of the disadvantages in the prior art and that provides a safer power tong. Thus in one embodiment there is provided a power tong for rotating a pipe, the power tong comprising: a frame having a pair of arcuate front portions defining a throat for receiving the pipe; a ring gear rotatably mounted on the frame about a center of rotation, the ring gear having a first opening that is alignable with the throat; the ring gear including a plurality of cam surfaces disposed circumferentially about the center of rotation; a cage plate assembly rotatably mounted on the ring gear about the center of rotation, the cage plate assembly having a second opening that is alignable with the throat; a plurality of die means mounted on the cage plate assembly, at least two of the die means each including a die, a die carrier and a cam follower; each of the cam followers being positioned to follow at least one of the cam surfaces; and the front portions of the frame having greater flexibility than the ring gear and the cage plate assembly.

In a further embodiment, the power tong further includes a drive train having a sequence of gears, the sequence of gears having a maximum backlash, and in which the flex of the ring gear under normal operating conditions is less than the backlash.

In a still further embodiment, the power tong the ring gear includes at least one pair of opposing cam surfaces, each of the cam surfaces having an elliptical section and opposing cam surfaces being offset from each other.

In a still further embodiment, the power tong includes cam surfaces each of which has the same section of an ellipse.

BRIEF DESCRIPTION OF THE DRAWINGS

There will now be described a preferred embodiment of the invention, with reference to the drawings, by way of illustration, in which like numerals denote like elements and in which.

DESCRIPTION OF PREFERRED EMBODIMENTS

Physical Configuration

Figure 1:
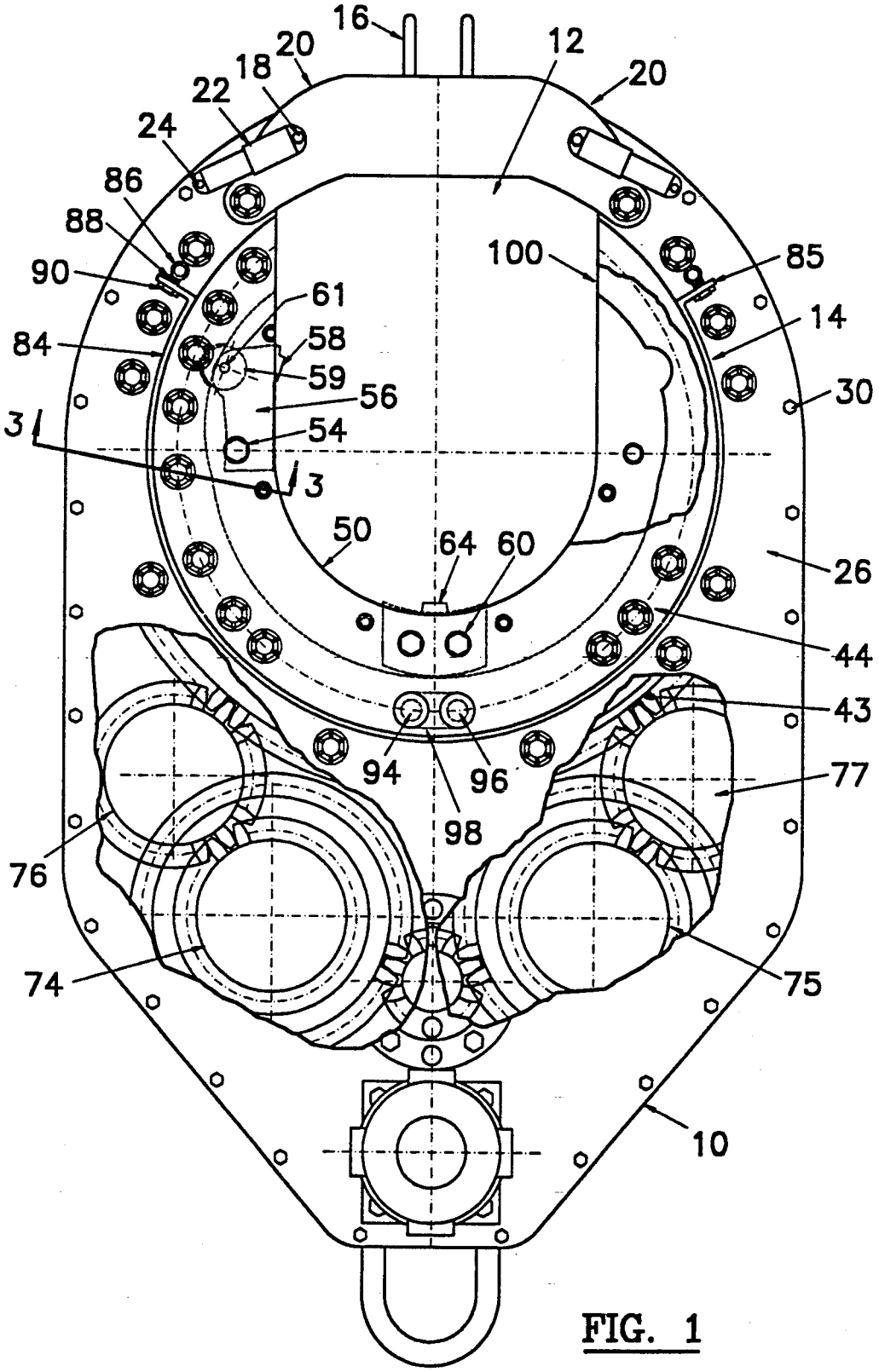
FIG. 1 is a plan view, partially cut away, of an open throat power tong according to the invention.
Figure 2:
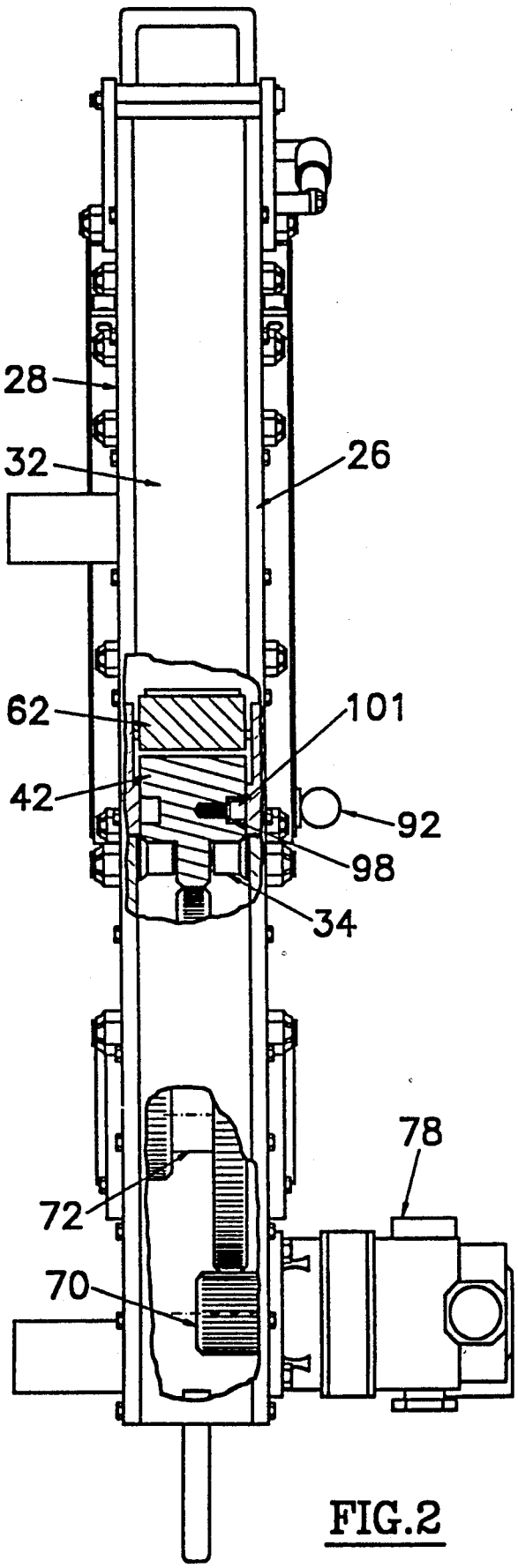
FIG. 2 is a side view, partially cut away, of the power tong shown in FIG. 1.

Referring to the drawings and in particular to FIGS. 1 and 2, there is shown respectively a plan view and a side view, each partially cut away, of an open throat power tong according to the present invention. In FIG. 1, a portion of the upper plate 26 of a power tong body and a portion of a cage plate assembly 44 is removed. In FIG. 2, a portion of the side wall 32 of a power tong body is removed and a section view of the ring gear 42 is shown.

Pivotally mounted to the frame 10, adjacent to the throat 12, by means of roller shaft pin 36 is a door 20 which may be opened by means of handle 16 to allow a tubular section to be placed in throat 12 of the power tong. Pivotally attached at 18 to the door 20, is one end of a spring loaded piston assembly 22. The other end of the piston assembly 22 is pivotally attached at 24 to the frame in order to retain the door in the open or closed position. The doors 20 and piston assemblies 22 are shown in the closed position in FIG. 1. Although the door mechanism may be open, a door latch mechanism not shown may be provided for cooperation with a corresponding hook (not shown) mounted to the opposite door, so that for the safety of the operator the door 20 can be securely locked in the closed position.

The frame 10 of the open throat power tong includes an upper plate 26 and a lower plate 28 spaced apart with side wall 32 between them and bolted together with bolts 30. The frame 10 has a pair of arcuate front portions 14 surrounding the cage plate assembly 44 and ring gear 42 and defining a throat 12 for receiving a tubular section to be threaded.

The arcuate front portions 14 are designed such that under normal operating conditions (equal to or lower than full rated torque) the front portions 14 will flex more than the ring gear 42 and cage plate assembly 44 or either of them. This objective is primarily realized by the selection of the materials forming the front portions 14 and the transverse width of the front portions (transverse is defined in relation to the direction of the opening of the throat 12, which is oriented in the longitudinal direction). Strain resulting from the torque of the ring gear during operation is primarily taken up by the relatively rigid ring gear and cage plate. The front portions 14 of the frame are designed to flex without reaching their maximum yield strength. The resistance for the flex will never be greater than the force the flanged rollers 34 can withstand before breaking. The front portions 14 of the frame will only flex enough to accommodate the circumferential increase of the ring gear 42 when it is operating to the maximum rated torque. The ring gear 42 and cage plate assembly 44 are designed to take the entire load applied to then by the die carriers 56 and 62, without reaching their maximum yield strength. The ring gear 42 and cage plate assembly 44 combination is also designed rigidly enough that when under full torque they will not increase circumferentially more than the gear train backlash will allow. The frame, ring gear and cage plate dimensions required may be calculated from a knowledge of the structure of these elements as set out in this patent and from well known formulas in the art.

For example, in the embodiment shown, the upper plate of the front portion is 3½ inches wide and ⅝ inches thick at the point perpendicular to a line that passes through the axis of the ring gear and that is parallel to the throat. The upper and lower plates may be made of ASTM A514 steel. The ring gear and cage plate dimensions may be chosen accordingly, as shown in the drawings and in accordance with the principles described here.

Figure 3:
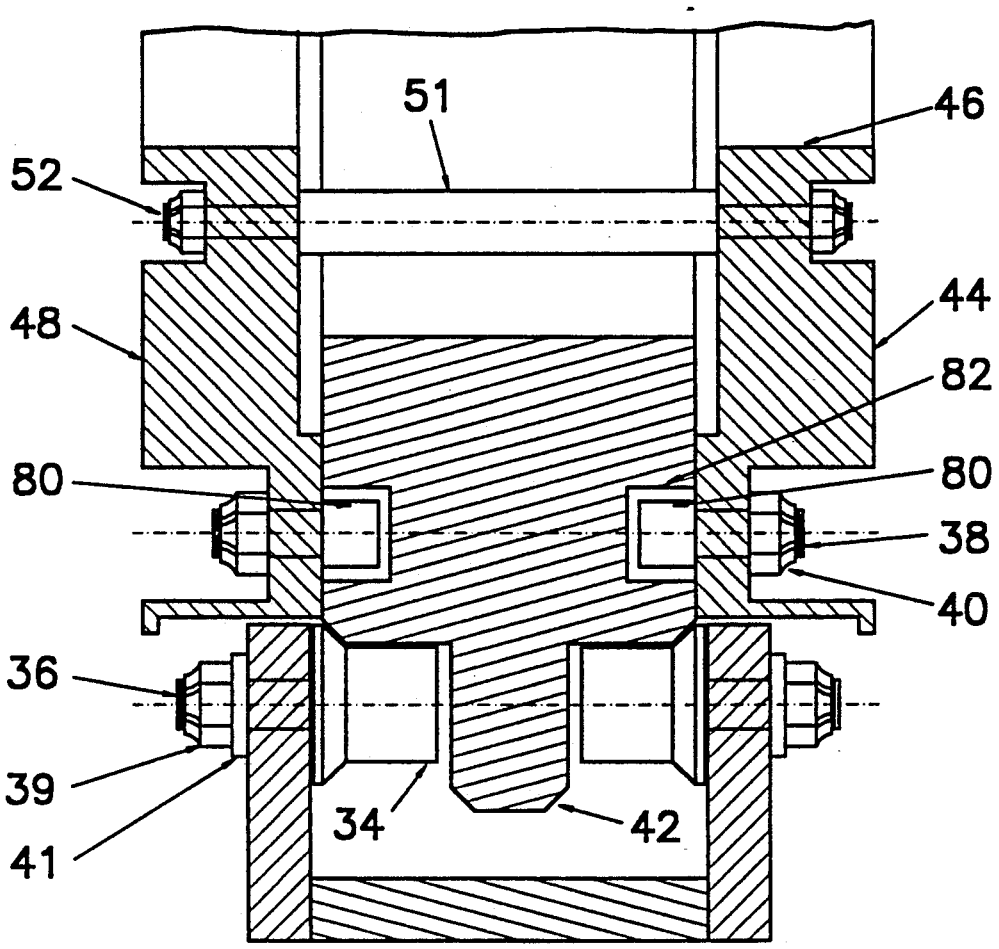
FIG. 3 is a side view cross-section along the line 3—3 in FIG. 1.

Mounted around the inner periphery of the front portion of the frame 10 (that is, about the throat 12) between upper and lower plates 26 and 28 are a plurality of flanged rollers 34. The flanged rollers 34 are shown in FIG. 3 and are rotatably mounted on a substantially vertical shaft or bolt 36 and held in place by a nut 39. A washer 41 may be located between the nut 39 and the plate 26.

A tubular section gripping mechanism 50 is provided within the front portion of the frame 10 and surrounding the throat 12 apart from the doors 20. The pipe gripping mechanism 50 includes a ring gear 42 mounted for rotation within the frame 10 and having an opening 100 adapted to be aligned with throat 12 of the frame 10. The ring gear 42 is guided on its outer periphery and retained within the frame 10 by flanged rollers 34. Rigidly secured to the outer periphery of the projection of the ring gear 42 are gear teeth 43.

The pipe gripping mechanism further includes a die carrier and cage plate assembly 44 which is mounted for rotation on the ring gear 42 and has an opening which is adapted to be aligned with the throat 12 of the frame 10 and the opening of the ring gear 100. The cage plate assembly 44 includes upper and lower arcuate plates 46 and 48 respectively spaced apart by spacers 51 and held together by nuts 52. The bottom side of the upper cage plate 46 and the top side of the lower cage plate 48 supports a series of bolts 38 which are held on by nuts 40. The bolts 38 are located on a bolt hole circle relative to the center of the cage plate and the bolts 38 support rollers 80. Rollers 80 rotate in arcuate grooves 82 which are machined in the top side and bottom side of the ring gear 42. This construction permits the cage plate 44 and the ring gear 42 to rotate relative to one another. It also permits any radial load that is applied to the ring gear to be partially supported by the rollers 80, which in turn are supported by the shafts 38, which in turn are supported by the cage plate assembly 44.

The cage plate assembly 44 and ring gear 42 are designed such that, under normal operating conditions, the die carrier to ring gear radial spreading force will not cause the cage plate assembly 44 and ring gear 42 to spread or flex more than the backlash in the gear train between the ring gear 42 and the gears 76 and 77 and between the gears 76 and 77 and the gears 74 and 75 respectively. In this patent, the flex of the ring gear is defined as the change in the position of the gear teeth that engage the drive train gears. The backlash is the space between the teeth of adjacent meshing gears. For example, the gears 76 and 77 have meshing teeth, but a gap remains between the teeth of one gear and the teeth of the other. This gap is the backlash.

Mounted to the upper plate 26 of the frame 10 is an arcuate brake band 84 terminating in a flange 85 with openings (not shown) for receiving eye bolts 88. The eye bolts 88 are attached to the upper plate 26 by shoulder bolt 86 which is positioned through the eye of eye bolt 88 and screwed into the upper plate 26. Eye bolts 88 extend through the openings of the brake band 84 and serve to attach the brake band 84 to the shoulder bolts 86. The eye bolts are retained to the brake band 84 by nuts 90. The brake band 84 partially surrounds and frictionally engages the outer periphery of the upper cage plate 46 of the die carriers 56 and 62. The brake band 84 is restrained from movement by a step on the upper cage plate 46 that is machined larger than the step on which the brake band 84 rides on. It is understood that the above brake band 84 may also be mounted on the bottom plate 28 and run on the bottom cage plate 48.

Pivotally mounted to the cage plate assembly 44 by hinge pins 54 are a pair of hinged die carriers 56 on either side of the throat 100 and one of which is shown in FIG. 1. The die carriers 56 have an identical construction so that only one need be described here. Each hinged die carrier 56 normally carries a front die 58. Each hinged die carrier 56 includes a head roller 59 which is rotatably mounted by a head roller pin 61 between the arcuate upper and lower plates 46 and 48 of the cage plate 44 and acts as a cam follower. Although a front die 58 has been illustrated, it will be appreciated that each of the hinged die carriers 56 may carry 2 or more dies mounted for engagement with a tubular member.

Loosely mounted to the cage plate assembly 44 between the arcuate upper and lower wall portions by pins 60 is a center die carrier 62. The back of the die carrier 62 directly contacts the ring gear 42, so that radial forces are transmitted directly to the ring gear 42. Each center die carrier 62 normally carries a front die 64. Although a front die has been illustrated it will be appreciated that the center die carrier 62 may carry two or more dies. The loose mounting allows adjustment of the die carrier 62 when the tubular section is gripped by the dies 58. The die carrier 62 has a metal on metal contact with the ring gear, but is not cammed.

The inner surfaces of the partial ring gear 42 are provided with arcuate cam surfaces adapted for engagement with the head rollers or cam followers 59. Although only one set of the cam surfaces is shown in FIG. 1, it should be clearly understood that a neutral cam surface or depression 66 and a pair of cam surfaces 67 and 68 are provided for each die carrier 56. Depression 66 serves as a neutral cam surface for receiving the head roller 59 when the pipe gripping mechanism is in its initial rest position. With the relatively deep cam surfaces shown, the tangent at the point of connection of the head rollers 59 with the cam surfaces 66 should not be at an angle of less than 90 degrees to a line joining the rotational axis of the cam follower 59 to the pivot point of the respective die 58, otherwise the cam follower may jam.

When the ring gear 42 is rotated with respect to the cage plate assembly 44 one each of the opposing cam surfaces 67 and 68 serve as cam surfaces for urging the dies into gripping engagement with the tubular section. When one each of the opposing cam surfaces is engaged, the pivot point radius of one die carrier 56 will be different from the equivalent pivot point radius of the other die carrier. The pivot point radius is the line from the pivot point 54 of one of the die carriers 56 to the contact point of its associated head roller 59 with the cam surface 67 or 68. Without correction, this would cause the die carriers 56 to move towards the center of rotation of the cage plate assembly 44 by different amounts.

The problem is also described in U.S. Pat. No. 4,084,453 to Farr et al, where one solution to the problem is presented. As is known in the art, the opposing cam surfaces 67 and 68 should be offset along a line towards the center of rotation of the cage plate assembly 44 in an amount equal to the difference in the distance from the minimum pivot distance to the maximum pivot distance on each die carrier head roller 58.

Figure 4:
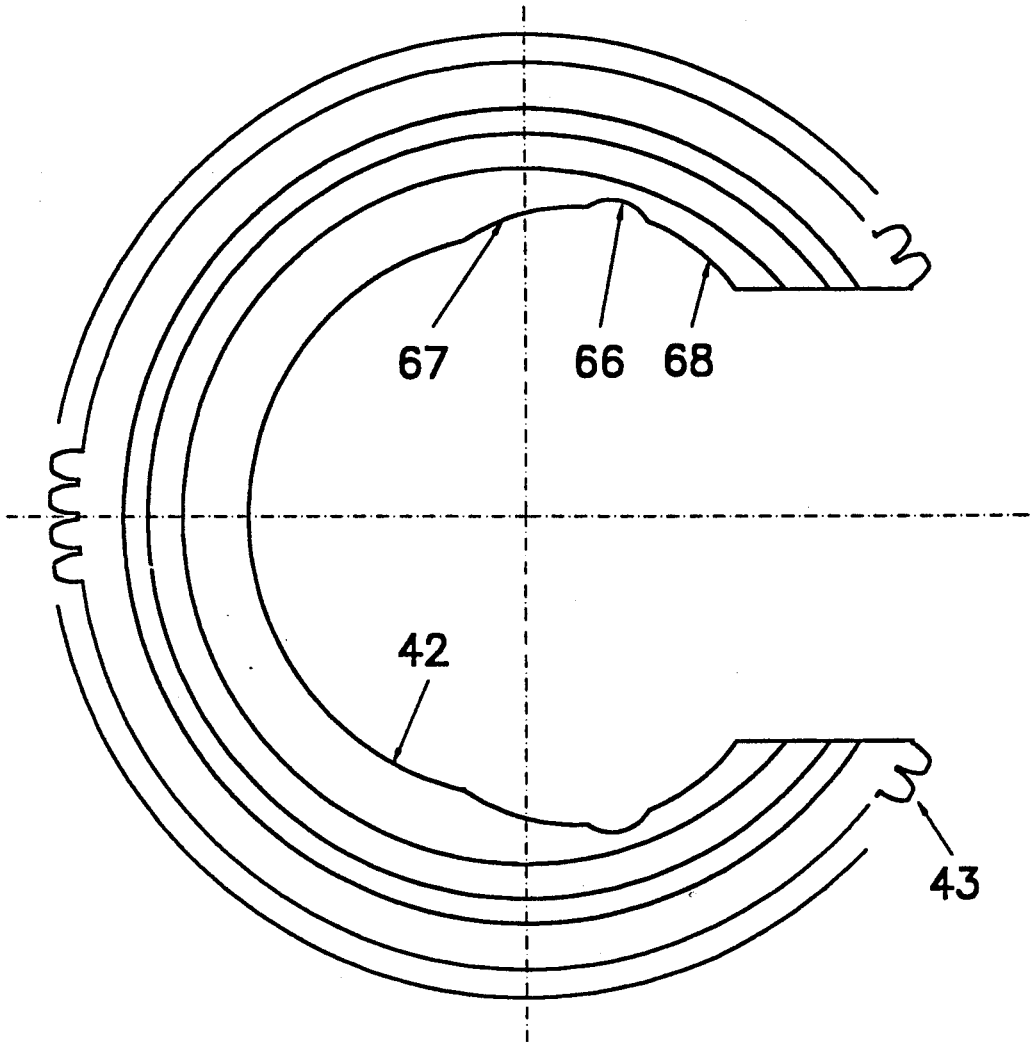
FIG. 4 is a plan view of a ring gear for use in a power tong according to the invention showing the elliptical cam surfaces.

Each cam surface 67 and 68 preferably has an identical elliptical section with a changing radius along its length. The tightest curve should be away from the respective depressions 66. This allows the die carriers 56 to ride further along the cam surfaces 67 and 68 as the speed of rotation increases, forcing the dies 58 inward and thus increasing the gripping force on the tubular section or pipe being rotated. The elliptical cam surfaces are shown in more detail in FIG. 4.

The ring gear 42 may be rotated relative to the frame 10 by means of a drive train shown in FIG. 1 and FIG. 2. The drive train includes a motor drive gear 70 which meshes with the pinion idler gear 72. The pinion idler gear 72 in turn drives the rotary idler gears 74, 75, 76 and 77 which mesh with the gear teeth 43 on the ring gear 42. The drive train is powered by a motor 78. It will be understood that any conventional motor may be employed which is capable of rotating the motor drive gear 70 in either direction, including particularly a dual speed hydraulic motor. It will be further understood that the spacing of gear 76 and the gear 77 is such that at least one of the gears 76 and 77 is always in driving engagement with the gear teeth 43 of the ring gear 42, even when the opening of the ring gear 42 is toward the rear end of the power tong assembly. It should also be understood that the sequence of gears 76 to 74 to 72 to 75 to 77 will contain enough backlash during normal operation to allow for the radial expansion of the ring gear 42. The backlash should not exceed industry accepted standards. These standards may be found in standard machinist handbooks. The ring gear flex is related to the change in the circumferential size of the ring gear 42. This size change is noticed in the throat of the ring gear. When the throat of the ring gear faces rearward, this size change is taken up by the backlash in the gear train.

The backing pin 92 can be inserted into one of the openings 94 or 96 in the upper cage plate 46. The openings 94 and 96 are positioned on either side of backing lug 98. The backing lug 98 is mounted in the upper arcuate groove 82 of the ring gear 42. The backing lug 98 is retained in place by bolt 101 threaded into the ring gear 42. The backing pin 92 abuts against the backing lug 98. This causes the ring gear 42, the cage plate 44, and the die carriers 56 and 62 to move in unison with their openings 12 and 100, and to be respectively aligned while the opening 100 of the ring gear 42 is being aligned with the throat 12 in the frame.

Operation of a Preferred Embodiment

In operation, the opening 100 of the ring gear 42 is aligned with the throat 12 in frame 10 so that the tubular section or pipe may be inserted into the interior of the ring gear 42. In inserting the tubular section, the door 20 is pivoted open to allow the tubular section to be placed in throat 12. When inserted the exterior surface of the tubular section comes into contact with the rear die 64 and the longitudinal axis of the pipe section is approximately coincident with the axis of rotation of the ring gear 42. After the tubular section is in position, power is applied by the motor 78 to rotate the ring gear either clockwise or counter clockwise. For the purpose of this explanation demonstration, it will be assumed that the ring gear 42 is rotated in the counter clockwise direction.

As the ring gear 42 begins to rotate in a counter clockwise direction from the position shown in FIG. 1, the cage plate 44 will remain stationary due to frictional engagement of the cage plate 44 with the brake band 84. Therefore, the cam surfaces 67 and 68 will move relative to the head rollers 59 on the hinged die carrier 56, respectively. Upon rotation of the ring gear 42, the cam surfaces 67 and 68 will cause the hinged die carrier 56 to pivot inward about the hinge pin 54 upon which it is mounted. These movements of the hinged die carrier 56 will bring the front die 58 into gripping engagement with the surface of the tubular section. The force exerted by the dies on the pipe is concentrated at or near the center of rotation of the tubular section. Moreover the force is evenly distributed and controlled so that the tube is gripped tightly enough to allow proper torque to be applied without crushing or damaging the pipe.

After the front dies 58 are brought into contact with the tubular section, further relative movement between the head rollers 59 and the cam surfaces 68 is not possible Accordingly the cage plate 44 will begin to rotate in unison with the ring gear 42. The tubular section, being tightly gripped by the front and rear dies against relative movement with respect to the cage plate 44, also will begin to rotate in a counter clockwise direction. This rotation may be continued for as many revolutions as may be required in order to make up or break apart a threaded connection between one end of a tubular section and another tubular section position in alignment therewith.

After the tubular section has been rotated sufficiently to make up or break apart the joint, the power tong may be freed from the tubular section by rotating the ring gear 42 in the opposite direction, namely in the clockwise direction in terms of this illustration, to position the head rollers 59 in the neutral cam surfaces 66. With the parts in this position, the front dies 58 may be disengaged from the tubular section and the power tong may be removed rearwardly to free the rear dies 64 from contact with the surface of the tubular section. Thereafter, the ring gear 42 may be further rotated in the clockwise direction, if necessary, to position its opening 100 in alignment with the throat 12. The rotation of the ring gear 42 will also cause cage plate 44 to be rotated back into its initial rest position by reason of the cooperation between backing pin 92 and backing lug 98 so that the tubular section may pass out of the power tong.

As will be appreciated, the power tong is also capable of rotating the tubular section in a clockwise direction. In order to accomplish this, the power tong is operated in a manner substantially as described above, the only difference being that the ring gear 42 is rotated in the opposite direction.

When the power tong is operating to full torque screwing together or taking apart tubular sections, the die carriers 56 roll up the cam surfaces 67 and 68 thus causing a radial and outward force to be applied to the ring gear 42. This force in turn is resisted by the ring gear 42 and cage plate assembly 44. The cage plate 44 and ring gear 42 will in turn flex open at their throats thus increasing the force on the flanged rollers 34. The frame 10 which supports the flanged rollers 34 is designed such that it will flex open before overloading the flanged rollers 34.

When the power tong is operating to full torque and the separating forces exerted between the meshing gear 42 to 76 and or 77 is exerted on the supporting arms of frame 10, frame 10 should not flex to the point where the gears meshes will disengage, nor of course past its materials yield point.

The weight of the ring gear 42 and the tubular section held by the dies creates a downward force exerted on the dies 58 and 64. The dies 58 and 64 in turn exert a downward force on the die carriers 56 and 62, which in turn exert a downward force on the cage plate assembly 44, which in turn exert a downward force on the ring gear 42, which in turn exerts a downward force onto the flanges of the flanged rollers 34.

In order to reduce the friction when the ring gear 42 is rotating and to transmit the load on the ring gear 42 to the frame 10, the flanged rollers 34 have flanges that form an angle $\alpha$ (see FIG. 3) with the axis of rotation of the flanges, where $\alpha$ is between 91 degrees and 179 degrees, and is about 150 degrees preferably, and the angle of the adjacent shoulder on the ring gear is complimentary to this angle.

It will be appreciated that skilled persons in the art could make immaterial modifications to the invention as defined in this patent and in the claims without departing from the essence of the invention.

I claim:

1. A power tong for rotating a pipe, the power tong comprising:

a frame having a pair of arcuate front portions defining a throat for receiving the pipe;

a ring gear rotatably mounted on the frame about a center of rotation, the ring gear having a first opening that is alignable with the throat;

the ring gear including a plurality of cam surfaces disposed circumferentially about the center of rotation;

a cage plate assembly rotatably mounted on the ring gear about the center of rotation, the cage plate assembly having a second opening that is alignable with the throat;

a plurality of die means mounted on the cage plate assembly, at least two of the die means each including a die, a die carrier and a cam follower;

each of the cam followers being positioned to follow at least one of the cam surfaces; and the front portions of the frame having greater flexibility than the ring gear and the cage plate assembly.

2. The power tong of claim 1 further including a drive train having a sequence of gears, the sequence of gears having a maximum backlash, and in which the flex of the ring gear under normal operating conditions is less than the backlash.

3. The power tong of claim 1 in which the ring gear includes at least one pair of opposing cam surfaces, each of the cam surfaces having an elliptical section and opposing cam surfaces being offset from each other.

4. The power tong of claim 3 in which each of the cam surfaces has the same section of an ellipse.

5. The power tong of claim 1 further including a third die carrier mounted on the cage plate assembly opposite to the second opening, the third die carrier directly contacting the ring gear.

* * * * *